United States Patent [19]

Kuether

[11] Patent Number: 4,521,926

[45] Date of Patent: Jun. 11, 1985

[54] BATH CHAIR

[76] Inventor: Christian L. Kuether, 5302 Crawford St., Houston, Tex. 77004

[21] Appl. No.: 425,042

[22] Filed: Sep. 24, 1982

[51] Int. Cl.[3] ..... A47K 3/022

[52] U.S. Cl. ..... 4/579

[58] Field of Search ..... 4/571, 573, 578, 579, 4/611, 615, 560, 604, 567–569

[56] References Cited

U.S. PATENT DOCUMENTS

| | | | |
|---|---|---|---|
| 2,237,076 | 4/1941 | Kenney et al. | 4/579 |
| 3,040,335 | 6/1962 | Gellman | 4/579 X |
| 3,346,885 | 10/1967 | Merriman | 4/579 X |
| 3,528,111 | 9/1970 | Chou | 4/579 X |
| 3,900,902 | 8/1975 | Jarosinski | 4/611 X |
| 3,902,200 | 9/1975 | Pratt | 4/579 |
| 4,100,628 | 7/1978 | Franzi | 4/579 |
| 4,150,445 | 8/1979 | Bailey | 4/567 X |
| 4,160,292 | 7/1979 | Kuether et al. | 4/615 |
| 4,391,006 | 7/1983 | Smith | 4/579 |

*Primary Examiner*—Charles E. Phillips

*Attorney, Agent, or Firm*—Berman, Aisenberg & Platt

[57] ABSTRACT

A bath chair is adapted to be used with an existing bathtub. The chair includes a stabilizing means for securing the chair to the tub, and water from the chair flows into the tub. A transfer seat is provided for assisting invalids in entering the chair. Improved water flow includes perineal outlets, and a splash plate is provided for other water outlets to force water to cascade down the back of the chair.

11 Claims, 7 Drawing Figures

BATH CHAIR

TECHNICAL FIELD

This application relates to a device for use in personal hygiene, and in particular to a device for permitting bathing of an invalid, a post-operative patient, or the like.

BACKGROUND ART

Bath chairs which are used for the bathing of invalids are known in the art. One such bath chair is shown by applicant's prior U.S. Pat. No. 4,160,292. This prior art bath chair has seat and back portions, and water is supplied to the upper edge of the back portion for application to the bather. Such bath chair is designed for resting directly on the floor and stands as an independent unit.

Other devices are known which are used in conjunction with a bathtub. These devices usually take the form of a stool which attaches to the bottom of the bathtub and allows the bather to sit on the stool while reaching into the water in the bathtub for bathing.

STATEMENT OF THE INVENTION

The bath chair shown in my previous patent suffers from several disadvantages. One such disadvantage is that it is designed to be independent of other bathing units, such as a bathtub. This means that the prior art chair must be installed in lieu of a bathtub, which requires an existing tub to be removed in order to install the prior art chair in the same location.

The present invention is designed for use in conjunction with a prior art bathtub. The inventive chair includes a stabilizing means for attaching the chair to an existing bathtub so that the new chair may be easily installed in tubs in existing bathrooms. The stabilizing means includes a ring which is attached to the bottom of the chair for engaging the sides of a bathtub. The ring is flexible so that when it is compressed in one dimension, another dimension increases to press against the sides of the tub. Drain outlets are provided for allowing waste water to drain into the tub to utilize the existing plumbing.

Another disadvantage of the earlier bath chair is that it is sometimes difficult for a person using the chair to enter it. This is particularly true since the users of the chair are typically invalids and lack the mobility of a healthy person.

The inventive chair provides a transfer seat which extends from one corner of the seat portion of the bath chair. This transfer seat allows the bather to move from a wheelchair to, first, sit on the transfer seat, to then rotate on the transfer seat so as to place the bather's feet in the foot bath, and lastly to move the bathing position in the bath chair. The transfer seat may extend from either the left or right side of the bath chair to accommodate installation in tubs which open on either side.

A further disadvantage of the earlier bath chair is that the water flow was not always appropriate to the specific needs of the bather. The prior bath chair employed a tube which was attached to the upper edge of the seat portion and which had holes for dispensing water. This arrangement was somewhat awkward and, further, did not provide for adequate perineal washing.

The improved bath chair provides a source of water at the upper edge of the back portion of the chair so that the water flows down the back of the chair. This water may be applied to the bather by the bather reclining in the chair to allow the water to flow onto the bather's back, or the bather may insert a washcloth into the flowing water and then apply it to the bather. The improved bath chair also provides for outlets so that water will be directed to the perineum of the bather. The water flow may be adjusted so that water is directed only to the perineum or so that water emerges from both the upper edge of the chair and the perineal area.

It is an object of this invention to provide a bath chair which is capable of use in an existing bathtub.

It is a further object of this invention to provide a bath chair which provides an improved method of entry and exit.

It is a further object of this invention to provide improved water flow in a bath chair.

DETAILED DESCRIPTION OF THE INVENTION

Figure 1:
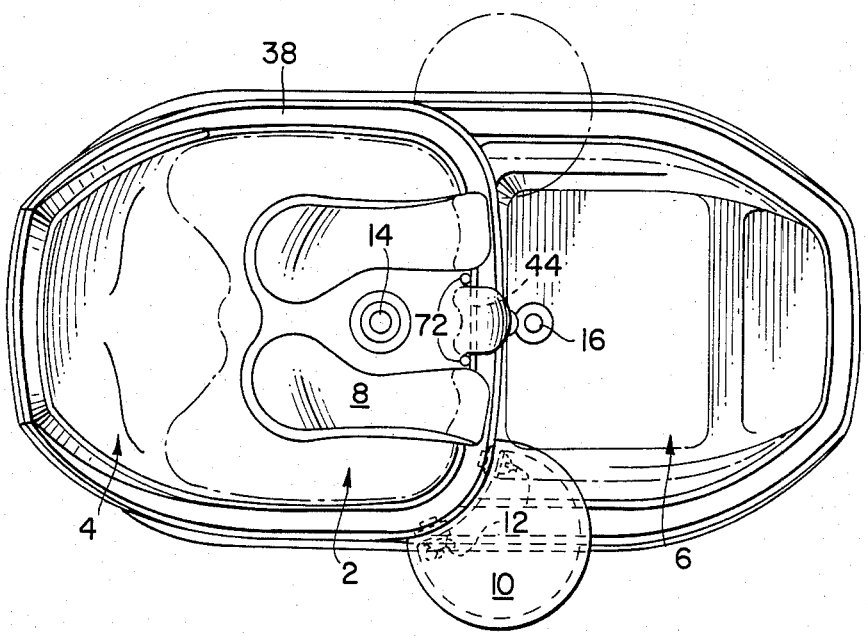
FIG. 1 is a top plan of the invention.

FIG. 1 shows a bath chair of the invention having a seat portion 2, a back portion 4 and a foot bath 6. The seat portion 2 forms a reservoir 3 (see FIG. 5) and includes a removable seat 8 which is supported by ledges which are formed in the reservoir 3, as will be more clear with regard to other figures. A transfer seat 10 is attached to one corner of the seat portion 2. This transfer seat has a concave upper surface to allow a bather to sit on the transfer seat and rotate to place his feet into the foot bath 6. The bather may then complete moving onto the removable seat 8. The transfer seat is secured to a vertical wall of the seat portion by bolts 12. The seat portion 2 has a drain 14 and the foot bath 6 has a drain 16 for allowing water in the seat portion cavity and the foot bath to drain into a bathtub in which the invention is located. These drains may be closed with a valve, or stopper, to allow water to accumulate in these areas.

Figure 2:
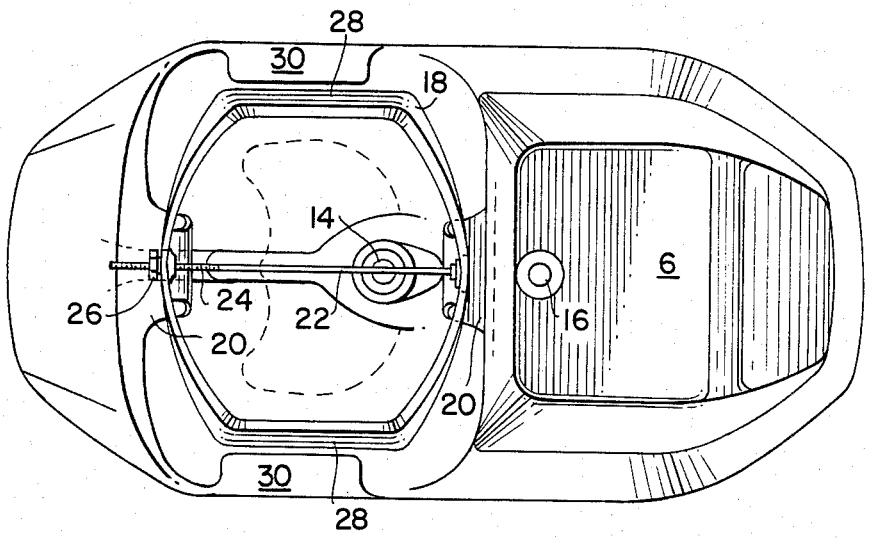
FIG. 2 is a bottom view of the invention.

FIG. 2 shows the structure which allows the inventive bath chair to be secured to a bathtub. A stabilizing means 18 comprises a flexible ring which will increase in one dimension when it is compressed in a transverse dimension. The stabilizing means 18 is attached to the bottom of the chair by straps 20. These straps may be secured to the bottom of the chair or may be an integral part of the chair. A rod 22 extends from one side of the stabilizing means to the other and has a threaded portion 24 at one end. A knob 26 cooperates with the threaded portion 24 so that as the knob is moved along the rod, the stabilizing means 18 is compressed in the direction of the rod. Compression in this direction will cause an expansion in a transverse dimension, so that tub-engaging sides 28 are pushed outwardly to engage the walls of the tub. In a preferred embodiment, the tub-engaging portions 28 are corrugated so as to be less flexible than the remainder of the stabilizing means 18. This assures that the portions 28 do not bend, but rather remain relatively flat to better contact the walls of the tub. The distance between the portions 28 is designed to accommodate the smallest tub which will be encountered. When a larger tub is used, pads 46 may be added to the sides 28 to increase the dimension. The increase in dimension due to compression by the rod 22 may be only about an inch so that pads will be added to the portions 28 to closely approximate the transverse dimension of the tub, as more clearly shown in FIG. 4. The seat portion 2 also employs lips 30, FIG. 3, which are adapted to hook over the upper edge of the bathtub. These lips support the vertical weight of the bath chair while the stabilizing means 18 prevents the bath chair from rotating or moving within the tub.

Figure 4:
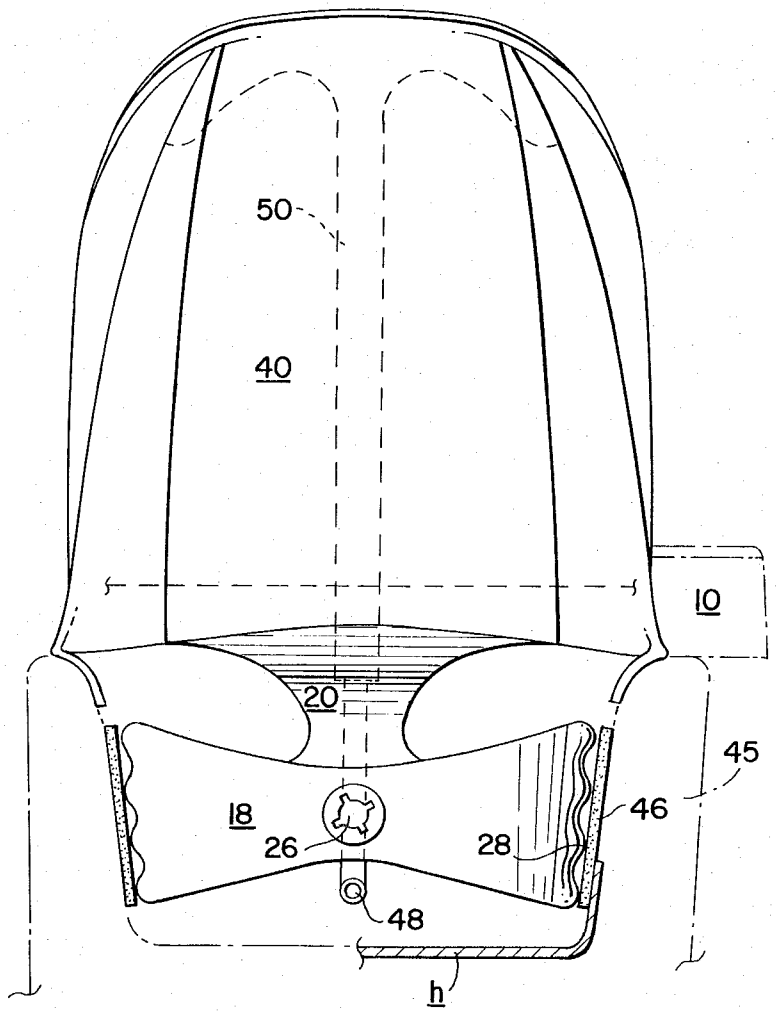
FIG. 4 is a rear elevation of the invention.
Figure 3:
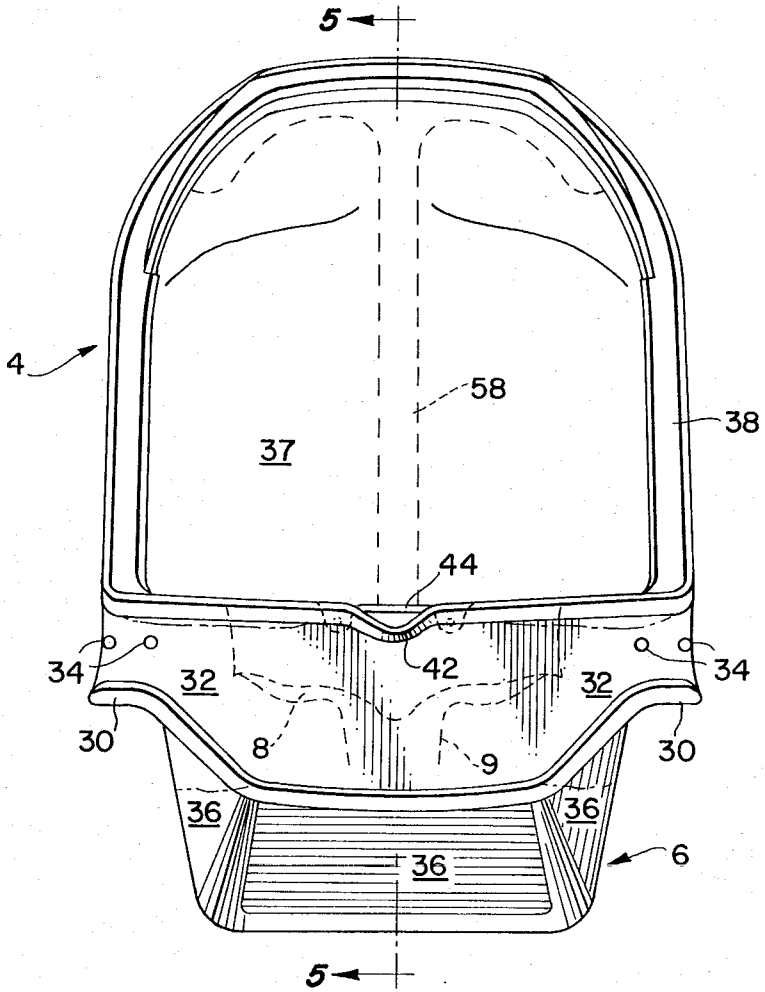
FIG. 3 is a front elevation of the invention.

FIG. 3 shows a front elevation view of the bath chair of the invention with the transfer seat removed. The transfer seat 10 may be attached to the vertical wall 32 of the chair by passing bolts 12 through holes 34. FIG. 3 shows the removable seat 8 in phantom lines, the seat being located behind the vertical wall 32. The foot bath 6 is formed of a plurality of surfaces which cooperate to create a cavity. Converging surfaces 36 are clearly seen in FIG. 3. The back portion 4 of the chair is a contoured element 37 which mates with a outer shell 40, which is shown in FIG. 4. As shown in FIG. 3, an edge 38 extends between the contoured inner surface 37 and the outer shell 40.

The seat portion 2 is bounded by a continuation of the edge 38. At the front part of the seat portion 2, the edge 38 has a valley-like portion 42 which allows the water in the cavity to flow into the foot bath portion 6. This valley-like part 42 is located below a extension 44 of the removable seat 8.

FIG. 4 is a rear elevation of the bath chair of the invention mounted in a bathtub 45. This figure shows pads 46 which have been attached to the rigid portions 28 of the stabilizer 18, as has been described above. A water inlet pipe 48 is shown in FIG. 4 and will be more fully described with respect to FIG. 5.

Figure 5:
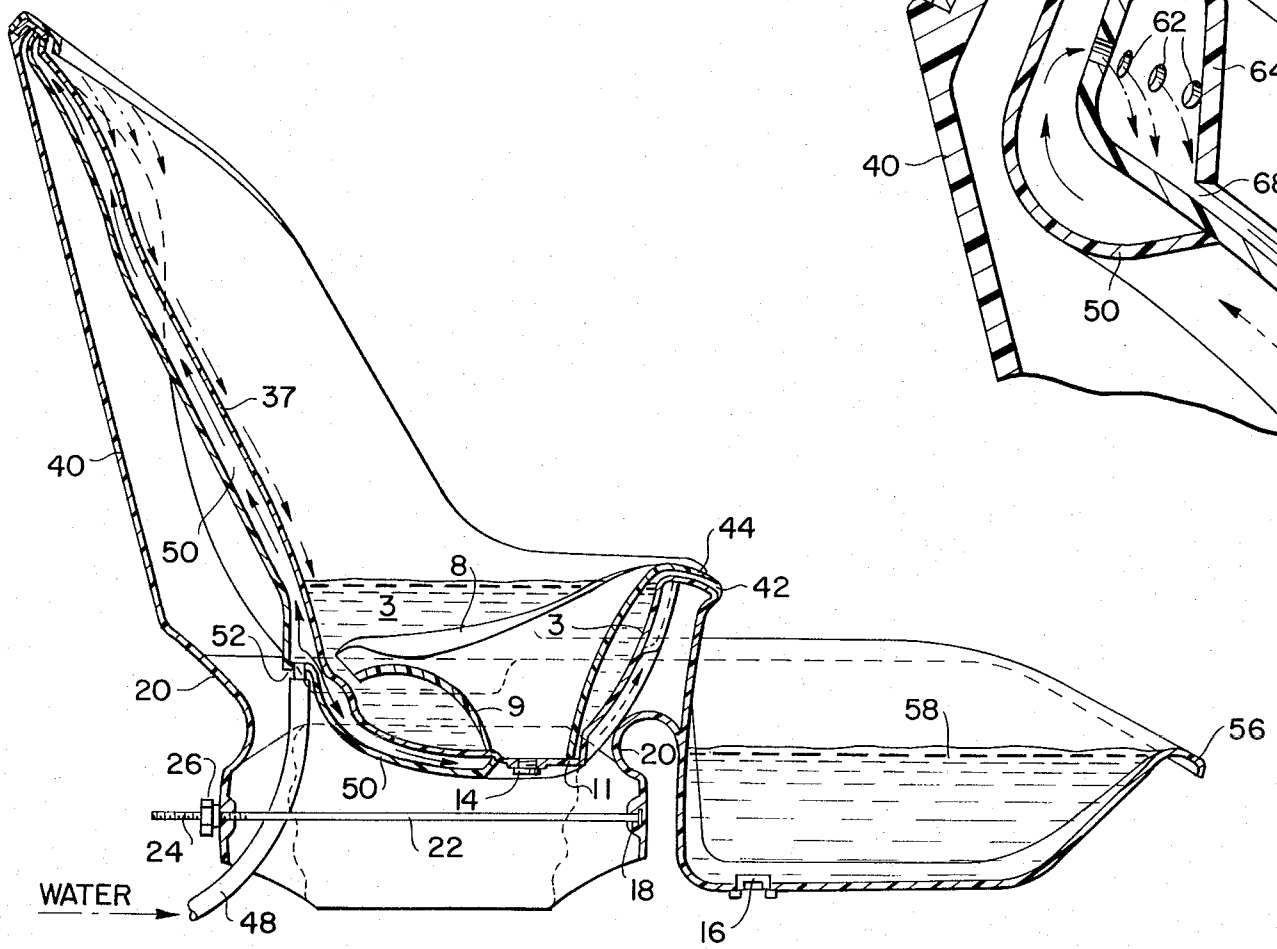
FIG. 5 is a cross-section of the invention taken along line 5—5 of FIG. 3.

FIGS. 3 and 4 show a manifold 50 in dashed lines and this will be described more completely below. FIG. 5 shows how water flows into the inventive bath chair and how the water levels are maintained. Water inlet 48 is connected to a source of water, such as an existing bathtub spigot and is attached to the manifold 50 by a connector 52. Manifold 50 operates to conduct water to the top of the back portion 4 and also along the bottom of the seat portion 2 to perineal outlets which will be described with respect to FIG. 7. The overflow valley 42 is arranged to provide a water level 54 in the seat portion 2, and an overflow valley 56 is formed in the foot bath portion 6 to provide water level 58. Seat portion 2 accumulates water which has flowed down the contoured portion 37 of the chair, and water which has been directed to the perineum by outlets in the seat portion 2. If the drain 14 is closed the water level will rise until it reaches the height 54 of the overflow 42. The overflowing water will then pass into the foot bath portion 6. If the valve 16 is closed, the water in the foot bath will rise to level 58 then pass overflow 56 into the bathtub. If desired, valve 14 may be opened and foot bath 6 filled by a separate water source.

The removable seat 8 has a funnel-shaped lower portion 9 which converges from an upper portion of the seat to a rim which is adjacent drain 14. As shown in FIG. 5, lower portion 9 is a continuous wall.

Figure 6:
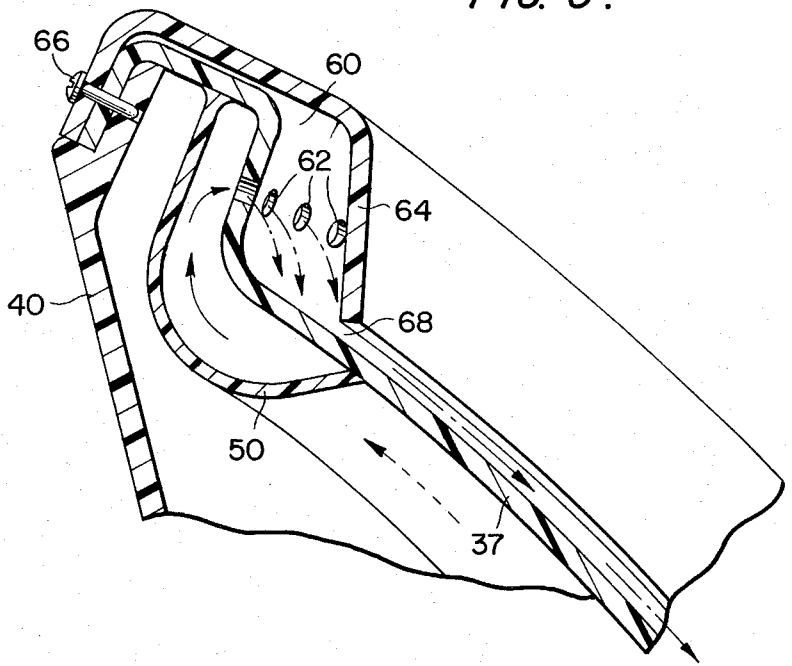
FIG. 6 is a cross-section along 5—5 of FIG. 3 showing a detail of the upper edge of the back portion of the invention.

FIG. 6 shows a detail of the structure by which water is admitted to the upper edge of the back portion 4. Contoured inner surface 37 curves up to form an upstanding portion 60 at the upper edge of the back portion 4. Upstanding portion 60 has holes 62 therein for passing water which has been directed to the holes by the conduit 50. As will be seen more clearly in FIG. 7, the conduit 50 is formed of a tube, U-shaped, in cross-section which is affixed to the back side of the contoured inner surface 37 to form a closed tube. As shown in FIGS. 3 and 4, the conduit 50 passes along the center portion of the bath chair and then extends along the upstanding portion 60 of the upper edge of the back portion 4. This T-shape allows water to be directed to a plurality of holes 62 located along the upstanding portion of conduit 50.

A deflector plate 64 is secured to the chair by a screw means 66. The deflector plate acts to cover the holes 62 so that water does not spray out of the holes and onto the bather. The plate 64 is spaced from inner surface 37 by a gap 68 so that water emerging from hole 62 is forced to flow down the surface 37 instead of being sprayed directly on the back of the bather.

FIG. 6 also shows how the chair includes the inner portion 37 and the outer portion 40 which are separately molded and then joined together.

Figure 7:
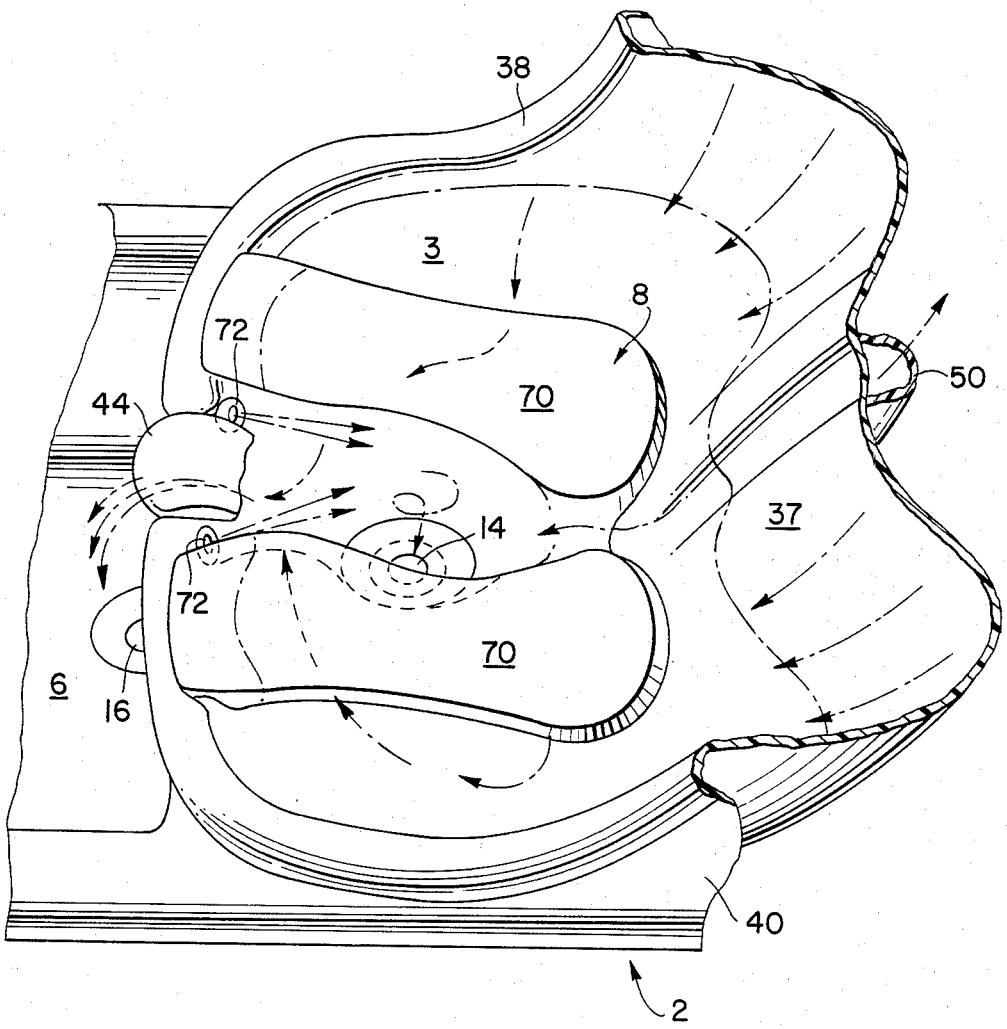
FIG. 7 is a perspective view of the seat portion of the invention showing the water flow.

FIG. 7 is a perspective view of the seat portion 2 of the invention. The removable seat 8 may be a piece of molded plastic having portions 70 to receive the buttocks of the bather. Perineal outlets 72 are fed by conduit 50 and are oriented to supply flowing water to the perineum of the bather. Water movement is indicated by arrows. Water enters the bath chair through connector 52 and a portion flows upward through conduit 50 and a portion flows downward to perineal outlets 72. Water flows down contoured inner surface 37 into reservoir 3 and water from perineal outlets 72 also flows into reservoir 3. Water in reservoir 3 then either flows out of drain 14 or through valley 42. As mentioned above, the drain 14 may be closed if it is desired to have the perineum below the water level, such as in a sitz bath.

While the inventive bath chair is preferably made of moulded fiberglass, it will be apparent that other materials are suitable.

It is claimed:

1. Apparatus for bathing comprising:

a chair having a seat portion and a back portion;

means for securing said chair to a bathtub comprising stabilizing means attached to said chair for gripping interior walls of said bathtub, whereby said chair may be placed in a bathtub and secured thereto and, wherein said stabilizing means comprises a flexible ring secured to said chair and further comprises means to compress said ring along one direction to expand said ring in a dimension transverse to said direction to secure said stabilizing means to said bathtub.

2. The apparatus of claim 1 further comprising a foot bath means located adjacent said seat portion for receiving the feet of a person sitting in said chair, and wherein said seat portion has an overflow means for allowing water from said reservoir to flow into said foot bath means.

3. The apparatus of claim 1 wherein the portions of said flexible ring which engage said bathtub walls are less flexible than the remainder of said ring.

4. The apparatus of claim 3 wherein said means to compress is a shaft which extends across said ring.

5. The apparatus of claim 4 wherein said chair includes lip means for engaging an upper edge of said bathtub for supporting the weight of said chair.

6. Apparatus according to claim 5 wherein said ring is below said seat portion, and is attached to said seat portion by two straps which depend from said seat portion.

7. Apparatus according to claim 1 further comprising means for supplying water to an upper portion of said back portion so that water will flow down said back portion and into said seat portion.

8. Apparatus according to claim 7 wherein said back portion is provided with holes for passage of said water, and further including a deflector plate facing said holes and having an edge spaced from a surface of said back portion, whereby water passing through said holes will be prevented from spraying onto a person sitting in said chair.

9. Apparatus according to claim 8 wherein water is supplied to said holes and said openings by a conduit formed by at least a portion of said chair.

10. Apparatus according to claim 1 further comprising a removable seat located in said seat portion, said removable seat comprising an upper part for receiving the buttocks of a bather and a continuous wall extending from said upper part into said seat portion.

11. Apparatus according to claim 10 wherein said seat portion forms a reservoir and has a drain at a bottom thereof, and wherein said continuous wall forms an edge adjacent said drain.

* * * * *